US005711222A

United States Patent [19]

Taylor et al.

[11] Patent Number: 5,711,222

[45] Date of Patent: Jan. 27, 1998

[54] METHOD AND APPARATUS FOR MOUNTING A FLAT PRINTING PLATE ON A CANTILEVERED PLATE CYLINDER OF A PRINTING PRESS

[75] Inventors: Matthew Alan Taylor; Gregory William Weiss, both of Barrington; John Joseph Dowling, Rollinsford, all of N.H.

[73] Assignees: Heidelberger Druckmaschinen AG, Germany; Heidelberg Harris, Inc., N.H.

[21] Appl. No.: 666,695

[22] Filed: Jun. 14, 1996

[51] Int. Cl.[6] ..... B41F 27/00

[52] U.S. Cl. ..... 101/383; 101/415.1

[58] Field of Search ..... 101/375, 376, 101/378, 382.1, 383, 389.1, 415.1, 479

[56] References Cited

U.S. PATENT DOCUMENTS 4,030,415 6/1977 Fellows ..... 101/389.1
4,089,265 5/1978 White et al. ..... 101/375
5,168,808 12/1992 Prem ..... 101/375
5,284,093 2/1994 Guaraldi et al. .

FOREIGN PATENT DOCUMENTS 107843 7/1982 Japan ..... 101/375
2 286 365 8/1995 United Kingdom .

*Primary Examiner*—Ren Yan
*Attorney, Agent, or Firm*—Kenyon & Kenyon

[57] ABSTRACT

A method and for mounting a flat printing plate on a cantilevered plate cylinder of a printing press, particularly in a lithographic web-fed rotary printing press. The printing plate is bent into an essentially cylindrical shape and inserted into a hollow tube. The tube and plate are slid from the side over a mandrel mounted on the plate cylinder. The mandrel expands the printing plate to a condition where the mandrel has an outer diameter which is smaller than the inner diameter of the tube and which is larger than the outer diameter of the plate cylinder. The tube and printing plate are slid down the length of the plate cylinder, and the ends of the plate are then locked using a lock-up device. The tube is then removed from the plate cylinder. Air bearings may be used on the mandrel or the plate cylinder, and the mandrel may be expandable.

20 Claims, 4 Drawing Sheets

16
10
8a
8b
156
12
6
30
32
26

METHOD AND APPARATUS FOR MOUNTING A FLAT PRINTING PLATE ON A CANTILEVERED PLATE CYLINDER OF A PRINTING PRESS

BACKGROUND OF THE INVENTION

1. Field of the Invention

The present invention relates to a method and apparatus for mounting a flat printing plate on a cantilevered plate cylinder of a printing press, particularly in a lithographic web-fed rotary printing press.

2. Description of the Prior Art

In order to mount a conventional flat printing plate on the plate cylinder body of a rotary printing press, the plate must be wrapped around the plate cylinder body and tightened by a lock-up device at the end portions of the plate. In prior art presses including a conventional plate cylinder which is rotatably supported by two bearings mounted to the right-hand and the left-hand side walls of the printing press, mounting of a flat printing plate is usually performed by inserting a first bent end of the printing plate into a first groove of the lock-up device, rotating the plate cylinder until the second end of the printing plate can be inserted into a second groove of the lock-up device, inserting the second end into the second groove, and then actuating the lock-up device, so that the printing plate is tightened and securely held on the circumferential surface of the plate cylinder body.

In presses using a cantilevered plate cylinder—a plate cylinder which is rotatably supported at only one end in only one side wall of the printing press—it is also possible to mount a conventional flat printing plate on the plate cylinder by sliding it from the side onto the plate cylinder body, such that the bent end portions of the printing plate are received and guided in an axially extending groove or recess formed in the plate cylinder body.

A method of sliding a conventional printing plate onto a cantilevered plate cylinder body from the side is described in, e.g., U.K. Patent Application No. 2 286 365. When mounting a flat printing plate according to the method described in U.K. Patent Application No. 2 286 365, the problem arises that it is difficult to hold the flat printing plate in a cylindrical shape to thereby obtain concentricity with the plate cylinder. Furthermore, the intrinsic forces of the resilient plate material, usually aluminum, which tend to keep the printing plate in its original flat state, cause friction between the plate material and the plate cylinder body which increases the forces which must be applied to slide the plate onto the plate cylinder body and which thereby also increases the danger of damaging the plate. Such damage, for example, can result in changes in the flat plate length or the geometry of the bent plate, severely affecting the quality of the printed product.

SUMMARY OF THE INVENTION

It is an object of the present invention to provide a method and apparatus for mounting a flat printing plate on a cantilevered plate cylinder body of a rotary printing press, in particular a lithographic web-fed rotary printing press, which allows precise and easy mounting of the plate, and which further reduces the danger of damaging the plate by changing its bent-plate geometry, its flat plate length, etc., during the mounting procedure.

According to the present invention, a method for mounting a flat printing plate onto a cantilevered plate cylinder of a printing press includes the steps of loosely rolling the printing plate until it is in an essentially cylindrical shape, inserting the plate into a hollow tube having an inner diameter which is slightly larger than the outer diameter of the plate cylinder body, sliding the tube with the printing plate over a mandrel from the side onto the plate cylinder body, where the mandrel is arranged concentric to the plate cylinder body and has an outer diameter which is smaller than the inner diameter of the tube and which is larger than the outer diameter of the plate cylinder body, fastening the printing plate by actuating a plate lock-up device, and sliding the tube off the plate cylinder.

According to another object of the present invention, the end portions of the printing plate are bent prior to inserting the printing plate into the tube and a recess is formed within the mandrel which allows free movement of the end portions when sliding the tube with the printing plate onto the plate cylinder body.

In a further embodiment of the present invention the gap in the printing plate is aligned with the gap in the plate cylinder body by an indexing feature before actuating the plate lock-up device.

According to another embodiment of the present invention, the mandrel includes a tapered portion for leading in and guiding the tube with the printing plate when sliding the tube and the printing plate onto the plate cylinder body.

In a further embodiment of the present invention there are provided air ports in the circumferential surface of the mandrel to create an air bearing for the tube and the printing plate when sliding the tube with the printing plate onto the plate cylinder body.

According to a further embodiments of the present invention the circumferential surface of the mandrel includes a low coefficient of friction with respect to the material of the printing plate.

In a further embodiment of the present invention the outer diameter of the mandrel and the inner diameter of the tube are chosen such that, when sliding the tube with the printing plate over the mandrel, the printing plate is forced into a circular cross-section with an inner diameter slightly greater than the outer diameter of the plate cylinder body.

According to another embodiment of the present invention, air ports are provided in the plate cylinder body forming an air bearing for supporting the tube with the printing plate when sliding them over the plate cylinder body.

According to a further embodiment of the present invention, the mandrel is permanently fixed to the plate cylinder body. In another embodiment of the present invention, the mandrel is removed from the plate cylinder body when the printing press is operated.

In another embodiment of the present invention the mandrel is mechanically or pneumatically expandable and the mandrel is expanded to press the printing plate against the inner surface of the tube after the leading end of the tube with the plate has been moved over the mandrel.

In a further embodiment of the present invention, during removal of the printing plate from the plate cylinder body, the tube is slid over the plate cylinder body, the lock-up mechanism is actuated to release the ends of the printing plate, and the tube with the printing plate inside is slid off the plate cylinder body.

In a further embodiment of the present invention the compressed air is switched on when removing the tube with the printing plate from the plate cylinder body.

In a final embodiment of the present invention the mandrel has a nozzle system with radially extending nozzles which provide an air cushion which forces the printing plate against the inner surface of the tube when sliding the tube with the printing plate over the plate cylinder body.

BRIEF DESCRIPTION OF THE DRAWINGS

The above-mentioned and other objects, features and advantages of the present invention will become more apparent by referring to the following description of preferred embodiments of the invention, taken conjunction with the accompanying drawings, in which.

DETAILED DESCRIPTION OF THE INVENTION

Figure 1:
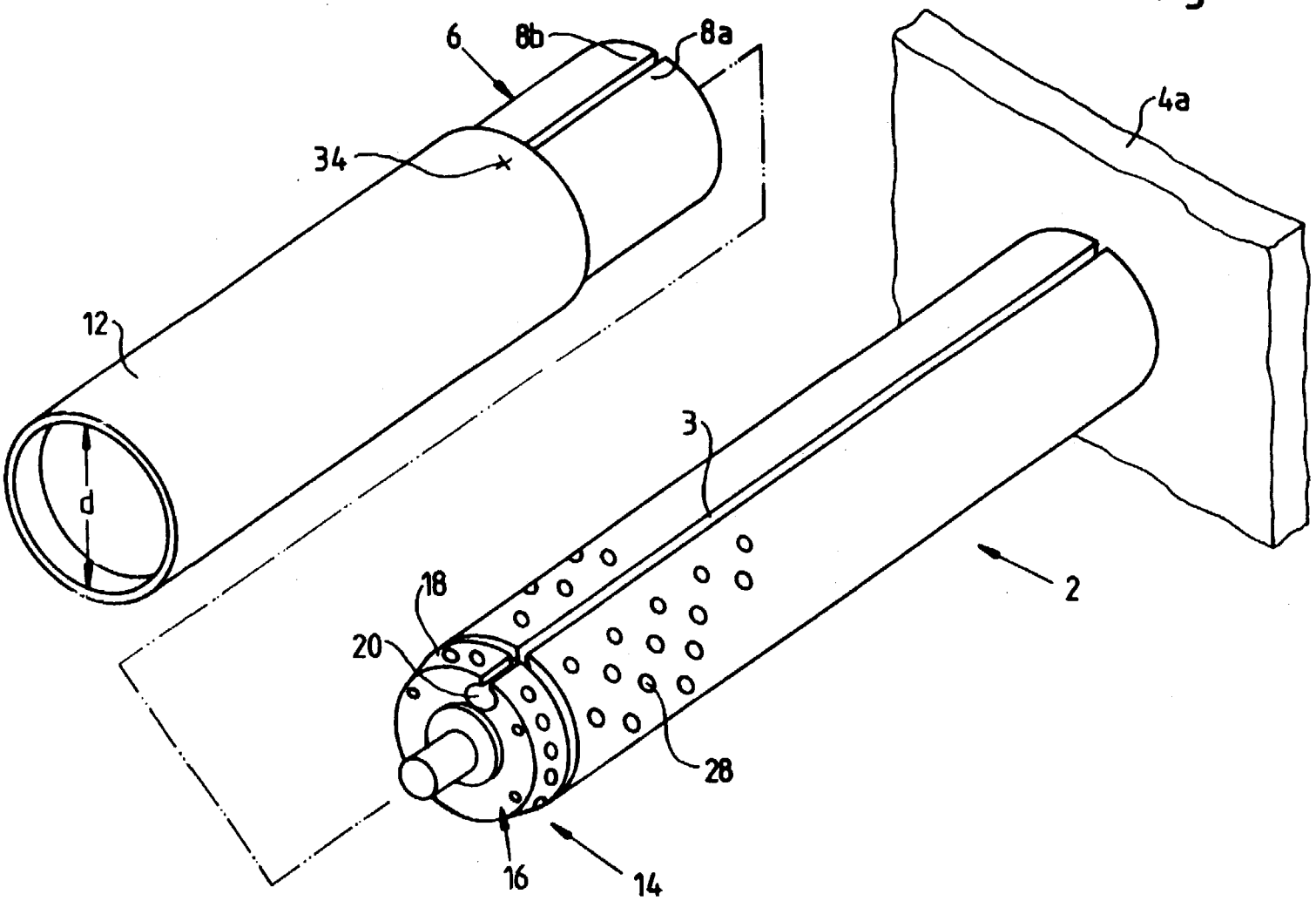
FIG. 1 is a schematic view of a hollow tube with a conventional printing plate which is mounted by sliding the tube with the printing plate over a mandrel onto the plate cylinder body from the side, according to the present invention.
Figure 2:
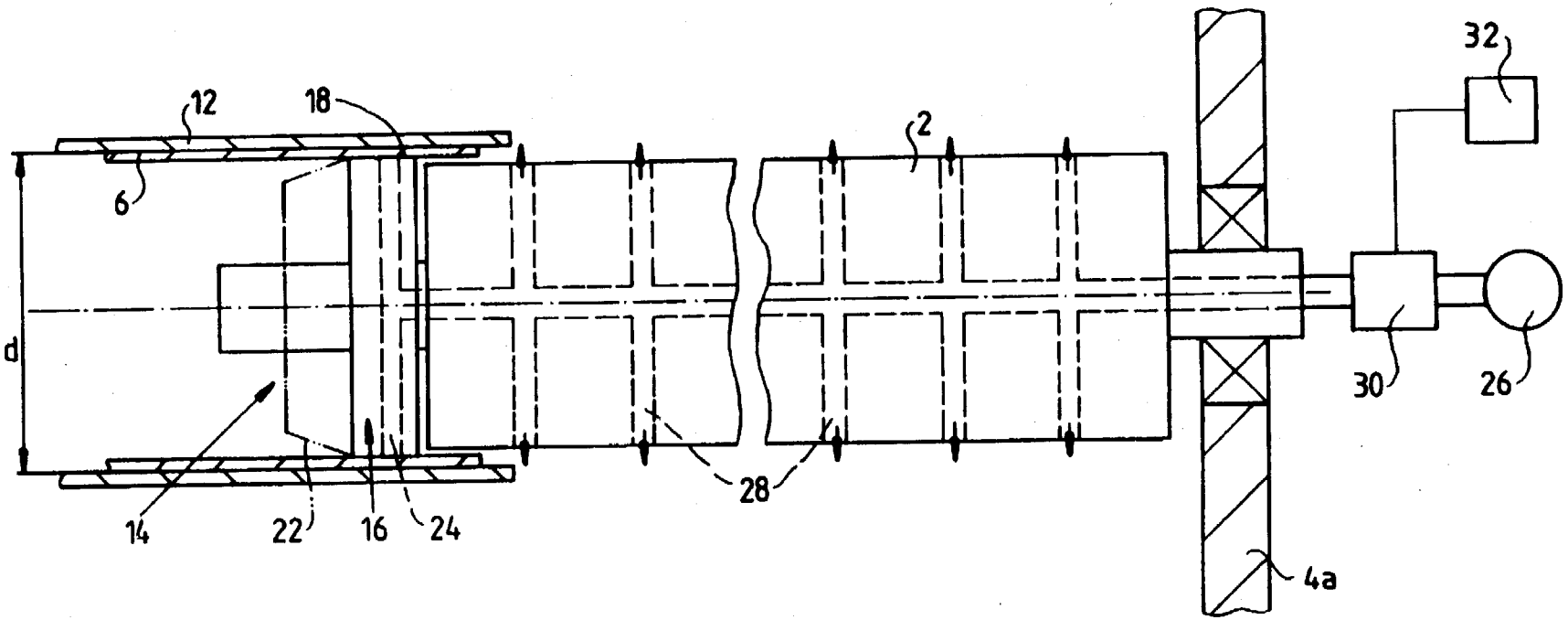
FIG. 2 is a schematic cross-sectional view of a hollow tube with a printing plate while they slide over the mandrel onto the body of a plate cylinder which is cantilevered in one side wall of the printing press.
Figure 3:
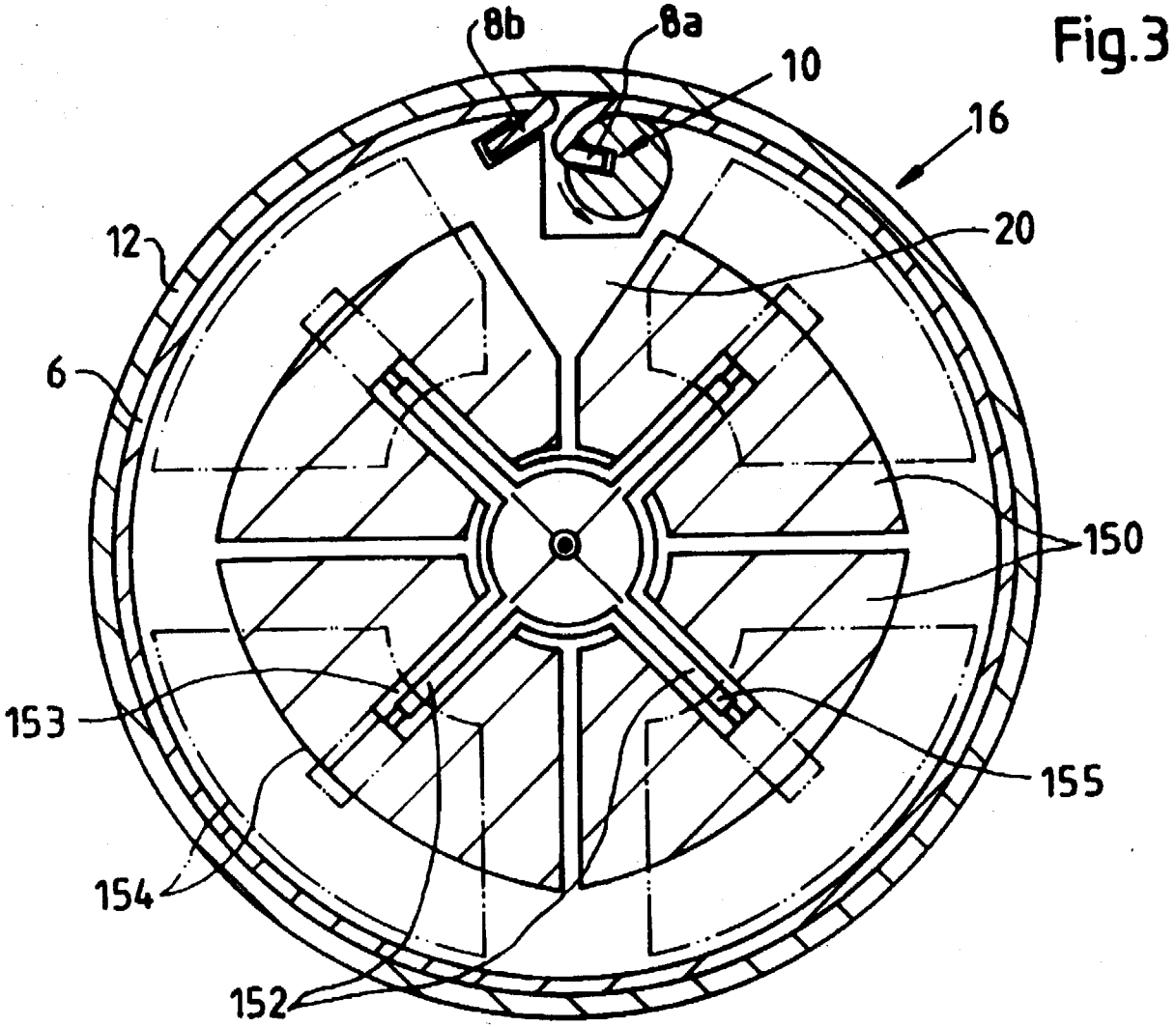
FIG. 3 is a cross-sectional view of an expandable mandrel inside a hollow tube with the printing plate.

As shown in FIGS. 1 and 2, a plate cylinder body 2 of a rotary printing press, particularly a lithographic web-fed rotary printing press, is cantilevered in a side wall 4*a* of the printing press, in order to allow changing of the printing plate 6 during a standstill condition of the press. The printing plate 6 is a commonly available flat offset printing plate, which includes a first end portion 8*a* and a second end portion 8*b* which are usually bent in a known plate-bending apparatus prior to mounting them on the plate cylinder body 2. As known from the art, the end portions 8*a* and 8*b* are each received in grooves of a known lock-up device 10 which is arranged within the plate cylinder body 2, as is schematically shown in FIG. 3. Such a device is disclosed in, e.g., U.S. Pat. No. 5,284,093.

To mount the printing plate 6 onto the plate cylinder body 2, the printing plate 6 is loosely rolled until it is in an essentially cylindrical shape, as shown in FIG. 1. The printing plate 6 is afterwards inserted into a hollow tube 12, which has an inner diameter d which is slightly larger than the outer diameter of the plate cylinder body 2. The tube 12 is preferably formed of a stiff material, e.g., plastic or metal, but can also be formed of a resilient or partially resilient material. In the preferred embodiment of the present invention, the inner surface of the tube 12 is formed of a material, e.g., PTFE (Teflon™), which has a low coefficient of friction, particularly with respect to the material of the printing plate 6. As a result, the printing plate 6 is easily movable within the tube 12, thereby reducing the danger of damage to the imaged surface of the printing plate 6.

At the free end 14 of the plate cylinder body 2 there is mounted a mandrel 16 coaxial with the plate cylinder body 2, as can be seen in FIGS. 1 and 2. The mandrel 16 can either be mounted permanently to the plate cylinder body 2, or it can be mounted to the free end 14 of the plate cylinder body 2 such that it is easily removable from the plate cylinder body 2. As shown in FIG. 2, the mandrel 16 includes a circumferential surface 18, which is slightly larger than the outer diameter of the plate cylinder body 2, but which is slightly smaller than the inner diameter d of the tube 12. The circumferential surface 18 of the mandrel 16 can be slightly tapered and is preferably also formed of a material with a low coefficient of friction such as PTFE, particularly with respect to the material of the printing plate 6. Additionally, the lead end of the tube 12, which is moved onto the plate cylinder body 2 first, can have a tapered section with a larger diameter than the diameter d of the trailing end of the tube 12. As shown in FIGS. 1 and 3, the mandrel 16 further includes a recess 20 which allows the free movement of the end portions 8*a*, 8*b* of the printing plate 6 when moving the printing plate 6 onto the plate cylinder body 2 from the side.

In order to move the tube 12 with the printing plate 6 onto the plate cylinder body 2, the tube is arranged concentrically with respect to the mandrel 16 and afterwards the tube 12 with the printing plate 6 is moved onto the plate cylinder body 2 from the side via the mandrel 16. While moving the tube 12 over the mandrel 16, the mandrel 16 forces the printing plate 6 against the inner surface of the tube 12, thereby giving the printing plate 6 a circular shape which essentially corresponds to the circular shape of the plate cylinder body 2. Since the fitting of the printing plate 6 within the space formed between the inner surface of the tube 12 and the outer circumferential surface of the mandrel 16 is preferably tight, a permanent and homogenous deformation of the printing plate 6 is achieved, so that the printing plate 6 keeps its circular shape after passing the mandrel 16.

After the tube 12 with the printing plate 6 has been completely moved over the mandrel 16, and the bent printing plate 6 is located on the plate cylinder body 2 in its desired position, the lock-up device 10 is actuated and the printing plate is tightened and securely held on the plate cylinder body 2 by the lock-up device 10. Afterwards, the tube 12 is removed from the plate cylinder from the side and the press is operated.

To remove the printing plate 6 from the plate cylinder body 2, the tube 12 is moved over the plate cylinder body 2 from the side, the lock-up device 10 is actuated to release the end portions 8*a*, 8*b* of the printing plate 6 and the tube 12, together with the printing plate 6, is removed from the plate cylinder body 2 from the side. Because of the remaining resilient forces within the printing plate 6, the outer surface of the printing plate 6 contacts the inner surface of the tube 12 while the tube 12 is moved off the plate cylinder body 2. In order to further reduce the danger of damages to the imaged surface of the printing plate, the tube 12 for removing the plate 6 can have a larger inner diameter d than the tube 12 which is used for mounting the plate 6.

In another embodiment of the invention which is shown in FIG. 2, the mandrel 16 can include a tapered portion 22 which makes it easier to move the tube 12 with the loosely rolled printing plate 6 onto the mandrel 16. The tapered portion 22 has a diameter which expands in the direction of the plate cylinder body 2. In order to reduce the friction between the printing plate 6 and the circumferential surface 18 of the mandrel 16, there can further be provided air nozzles or air ports 24 within the circumferential surface 18 of the mandrel 16 which can be supplied with compressed air from a compressed-air supply 26, thereby creating an air bearing when sliding the tube 12 with the plate 6 onto the plate cylinder body 2.

In a further embodiment of the present invention, there can also be provided air ports or air nozzles 28 within the circumferential surface of the plate cylinder body 2, which can be connected to the same compressed-air supply 26. The blast air or compressed air supplied to the air ports 24 and/or the air ports 28 is preferably controlled by a valve 30 which can be controlled, e.g., by the central control unit 32 of the printing press, or which can be controlled manually. The compressed air supplied to the air ports 24, 28 is preferably switched on during mounting and/or removing of the printing plate 6, as described hereinabove, thereby forming an air bearing for the tube 12 and the plate 6 when sliding them onto and off the plate cylinder body 2.

As shown in FIG. 1, there can further be provided an indexing feature or indexing device 34, preferably a mark on the outer surface of the tube 12, for aligning the gap or seam in the plate cylinder body 2 with the gap or seam in the printing plate 6 formed between the two end portions 8*a*, 8*b*.

In a further embodiment of the invention which is shown in FIG. 3, the mandrel 16 can be an expandable mandrel 16, whose diameter can be increased or reduced either mechanically or by means of compressed air, e.g., supplied from the compressed-air supply 26 and the valve 30. In this embodiment of the present invention, the mandrel 16 includes segments 150 which are supported on radially extending support elements 152 which are arranged at the plate cylinder body 2 and which allow a radial movement of the segments 150 with respect to the center, as indicated by the dashed lines of FIG. 3. In the preferred embodiment of the present invention, the segments 150 of the expandable mandrel 16 include a circumferential curvature 154 which corresponds to the curvature of the inner surface of the tube 12. As shown in FIG. 3, the support elements 152 can be received in respective holes 153 formed in the segments 150, and the compressed air is supplied through supply openings 155 formed in the elements 152, acting on the elements 150 such that they are forced away from the center of the mandrel 16.

In this embodiment of the invention, the segments 150 are first located in their inner position (full lines in FIG. 3), and after the leading end of the tube 12 with the printing plate has been moved over the mandrel 16, the compressed air is switched on and the segments 150 are forced towards the inner surface of the tube 12 by the compressed air, thereby pressing the printing plate 6 against the inner surface of the tube 12 until the respective part of the printing plate 6 makes a circular shape. Afterwards, the tube 12 is moved off the plate cylinder body 2 from the side, as described hereinbefore. For removing the printing plate 6, the compressed air for expanding the mandrel 16 is switched off and the mandrel 16 is contracted by, e.g., resilient devices such as retaining springs (not shown), or by applying suction instead of compressed air.

Figure 4:
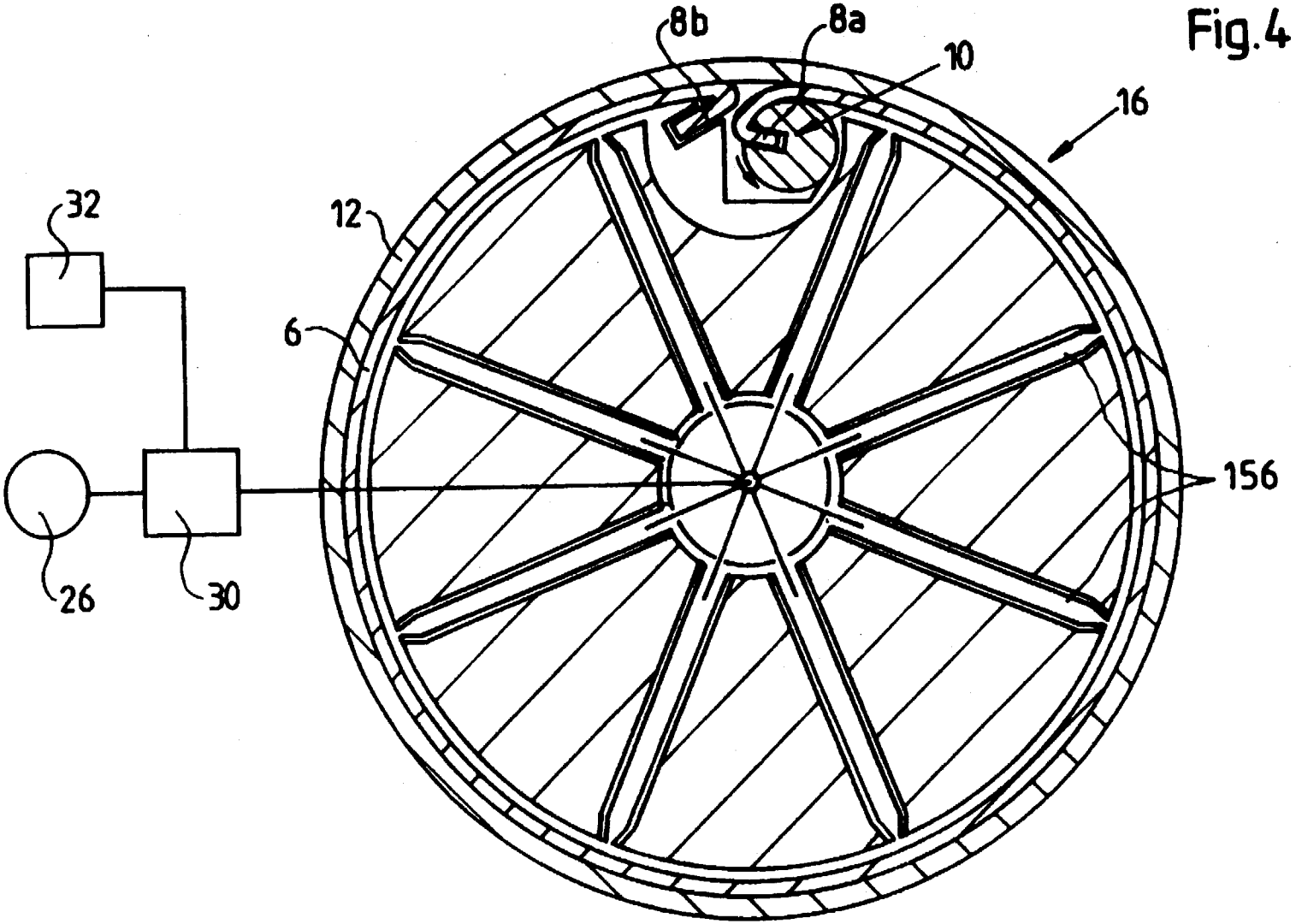
FIG. 4 shows a further embodiment of a mandrel which is formed by a set of nozzles.

In a further embodiment of the present invention, which is shown in FIG. 4, the mandrel 16 can include a set of radially extending nozzles 156, which are connected to a compressed-air supply, e.g., the compressed-air supply 26, via a valve 30. After the trailing end portion of the tube 12 with the printing plate 6 has been moved over the nozzles 156, the compressed air is switched on, the printing plate 6 is forced against the inner surface of the tube 12 and then the tube 12 with the printing plate 6 is slid over the plate cylinder body 2, as described hereinbefore. In the embodiment of FIG. 4, the mandrel 16 need not be of a diameter greater than that of the plate cylinder body 2.

From the above description of the invention, those skilled in the art will perceive improvements, changes and modifications. Such improvements, changes and modifications within the skill of the art are intended to be covered by the appended claims.

What is claimed is:

1. A method for mounting a flat printing plate on a cantilevered plate cylinder of a printing press, comprising the steps of:

bending the printing plate into an essentially cylindrical shape;

inserting the printing plate into a hollow tube having an inner diameter which is slightly larger than an outer diameter of the plate cylinder;

sliding the tube and the printing plate over a mandrel from the side and onto the plate cylinder, whereby the mandrel is concentric to the plate cylinder and has an outer diameter which is smaller than the inner diameter of the tube and which is larger than the outer diameter of the plate cylinder;

fastening the printing plate to the plate cylinder by actuating a plate lock-up device; and sliding the tube off the plate cylinder.

2. The method of claim 1, further comprising the step of:

bending end portions of the printing plate prior to inserting the printing plate into the tube, and wherein the mandrel comprises a recess aligned with a gap in the printing plate, the step of sliding the tube with the printing plate over the mandrel comprising sliding the end portions through the recess.

3. The method of claim 1, further comprising the step of:

aligning a gap in the printing plate with a gap in the plate cylinder using an indexing feature on the tube.

4. The method of claim 1, further comprising the step of:

creating an air bearing for the tube and the printing plate during the step of sliding the tube with the printing plate over the mandrel.

5. The method of claim 1, wherein:

the step of sliding the tube with the printing plate over the mandrel comprises forcing the printing plate into a circular cross-section with an inner diameter slightly greater than the outer diameter of the plate cylinder.

6. The method of claim 1, further comprising the step of:

creating an air bearing for the tube and the printing plate during the step of sliding the tube with the printing plate onto the plate cylinder.

7. The method of claim 1, further comprising:

removing the mandrel from the plate cylinder before operation of the printing press.

8. The method of claim 1, further comprising the step of:

expanding the mandrel to press the printing plate against the inner surface of the tube after a leading end of the tube has been moved over the mandrel.

9. The method of claim 1, further comprising the step of:

removing the printing plate from the plate cylinder, the step of removing the printing plate from the plate cylinder comprising the steps of:

sliding a tube over the plate cylinder;

actuating the lock-up mechanism to release the ends of the printing plate; and sliding the tube, with the printing plate inside, off the plate cylinder.

10. The method of claim 9, wherein:

the step of removing the printing plate from the plate cylinder further comprises the step of providing compressed air to an inner surface of the printing plate.

11. An apparatus for mounting a flat printing plate on a printing press, comprising:

a cantilevered plate cylinder, said cantilevered plate cylinder having an outer diameter;

a hollow tube having an inner diameter which is slightly larger than the outer diameter of the plate cylinder; and a mandrel concentric to the plate cylinder and mounted on the plate cylinder, the mandrel having an outer diameter which is smaller than the inner diameter of the tube and which is larger than the outer diameter of the plate cylinder.

12. The apparatus of claim 11, wherein:

the mandrel comprises a tapered portion which has a diameter which expands in the direction of the plate cylinder.

13. The apparatus of claim 11, wherein:

air ports are provided on the circumferential surface of the mandrel to create an air bearing when sliding the tube and the printing plate onto the plate cylinder.

14. The apparatus of claim 11, wherein:

the circumferential surface of the mandrel comprises a material of a low coefficient of friction with respect to the material of the printing plate.

15. The apparatus of claim 11, wherein:

the mandrel is permanently fixed to the plate cylinder.

16. The apparatus of claim 11, wherein:

the mandrel comprises a recess aligned with a gap in the printing plate.

17. The apparatus of claim 11, wherein:

the tube comprises an indexing feature.

18. The apparatus of claim 11, wherein:

the mandrel is expandable to a condition wherein the mandrel has an outer diameter which is smaller than the inner diameter of the tube and which is larger than the outer diameter of the plate cylinder.

19. An apparatus for mounting a flat printing plate on a cantilevered plate cylinder of a printing press, comprising:

said flat printing plate;

said plate cylinder;

a hollow tube having an inner diameter which is slightly larger than an outer diameter of the plate cylinder; and a mandrel concentric to the plate cylinder and mounted on the plate cylinder, the mandrel comprising a nozzle system with radially extending nozzles which provide an air cushion which forces the printing plate against the inner surface of the tube when said flat printing plate is inserted within the hollow tube and when sliding the tube with the printing plate over the plate cylinder.

20. A method for mounting a flat printing plate on a cantilevered plate cylinder of a printing press, comprising the steps of:

bending the printing plate into an essentially cylindrical shape;

inserting the printing plate into a hollow tube having an inner diameter which is slightly larger than an outer diameter of the plate cylinder;

sliding the tube and the printing plate over a mandrel from the side and onto the plate cylinder, whereby the mandrel provides an air cushion which forces the printing plate against the inner surface of the tube when sliding the tube with the printing plate over the mandrel;

fastening the printing plate to the plate cylinder by actuating a plate lock-up device; and sliding the tube off the plate cylinder.

* * * * *